US006853274B2

(12) United States Patent
Millburn et al.

(10) Patent No.: US 6,853,274 B2
(45) Date of Patent: Feb. 8, 2005

(54) CIRCUIT BREAKER

(75) Inventors: Jonathan Edward Millburn, Easton, MD (US); Noel Keith Ware, Dagsboro, DE (US); Mervyn Bradshaw Johnston, Easton, MD (US)

(73) Assignee: Airpax Corporation, LLC, Frederick, MD (US)

( * ) Notice: Subject to any disclaimer, the term of this patent is extended or adjusted under 35 U.S.C. 154(b) by 78 days.

(21) Appl. No.: 10/175,719

(22) Filed: Jun. 19, 2002

(65) Prior Publication Data

US 2002/0196108 A1 Dec. 26, 2002

Related U.S. Application Data

(60) Provisional application No. 60/299,639, filed on Jun. 20, 2001.

(51) Int. Cl.[7] ..... H01H 75/00

(52) U.S. Cl. ..... 335/6; 335/202; 200/293

(58) Field of Search ..... 335/6, 16, 147, 335/195, 165–176, 202, 132; 200/293–308

(56) References Cited

U.S. PATENT DOCUMENTS

| | | | | |
|---|---|---|---|---|
| 3,497,838 A | | 2/1970 | Merriken et al. | |
| 3,626,338 A | * | 12/1971 | Nicol | 335/172 |
| 3,786,380 A | | 1/1974 | Harper | |
| 3,959,755 A | | 5/1976 | Harper et al. | |
| 4,062,052 A | | 12/1977 | Harper et al. | |
| 4,117,285 A | | 9/1978 | Harper | |
| 4,206,430 A | * | 6/1980 | Rusch et al. | 335/20 |
| 4,276,526 A | | 6/1981 | Ciarcia et al. | |
| 4,437,488 A | | 3/1984 | Taggart et al. | |
| 4,492,941 A | | 1/1985 | Nagel | |
| 4,528,531 A | | 7/1985 | Flick et al. | |
| 4,912,441 A | | 3/1990 | Runyan et al. | |
| 5,066,935 A | | 11/1991 | Harper | |
| 5,117,208 A | | 5/1992 | Nar | |
| 5,162,765 A | | 11/1992 | DiVincenzo et al. | |
| 5,214,402 A | | 5/1993 | DiVincenzo et al. | |
| 5,293,016 A | | 3/1994 | Nar | |
| 5,463,199 A | | 10/1995 | Divincenzo et al. | |
| 5,557,082 A | | 9/1996 | Leet et al. | |
| 6,420,948 B1 | * | 7/2002 | Runyan | 335/6 |

OTHER PUBLICATIONS

EIA Standard–310–D Sep. 1992.
UL 489A, "Circuit Breaker for Use in Communications Equipment", Jun. 12, 1998.

* cited by examiner

*Primary Examiner*—Lincoln Donovan
(74) *Attorney, Agent, or Firm*—Milde & Hoffberg, LLP

(57) ABSTRACT

A circuit breaker having a manual control, an over-center contact mechanism, and a magnetic current sensing coil, wherein said an over-center contact mechanism is disposed between said external manual control and said sensing coil. For example, a collapsible toggle linkage selectively applies a force along an axis, which generally intersects the coil. The circuit breaker has a housing for a contact mechanism having a contact bar rotational axis. The magnetic sensing coil of the circuit breaker is not disposed between the contact mechanism and a side wall of the housing.

30 Claims, 5 Drawing Sheets

CIRCUIT BREAKER

RELATED APPLICATIONS

This application claims benefit of priority from U.S. Provisional Patent Application No. 60/299,639, filed Jun. 20, 2001.

FIELD OF THE INVENTION

The present invention relates to the field of circuit breakers, and more particularly to packaging and layout of mechanical components of circuit breakers.

BACKGROUND OF THE INVENTION

A circuit breaker is a packaged device, which serves to interrupt electrical current flow in an electrical circuit path upon the occurrence of an overcurrent in the circuit path. Typically, the circuit breaker provides a form of temporal averaging of the current, such that noise or transients do not trigger the breaker, while significant overcurrents rapidly trip the breaker. In addition, circuit breakers typically have a user interface comprising a handle, depressible surface, or toggle, to provide manual control over the breaker and possible visible or palpable indication of state. The typical circuit breaker has four main components: the housing, the mechanism that operates the switching contacts, the current sensor, and the user interface.

Typically, the breaker is arranged with the user interface elements on a face of the breaker, with the electrical interface on an opposite side of the housing. Inside the housing, the contact arm, and collapsible toggle linkage mechanism for breaking the circuit, are generally placed adjacent to the current sensor, e.g., particularly a magnetohydrodynamic coil.

The contact arm of a circuit breaker has a relatively strong spring, to assure rapid and reliable breakage of the circuit after a trip event. The trip element and toggle linkage are connected through a pivoting arm or armature, which, when activated, triggers a collapse of the toggle linkage, resulting in a rapid opening of the circuit. When the overcurrent occurs, the external toggle handle will normally return from the ON position to the OFF position.

Because the user interface must apply a significant force to place the contact arm in the conducting position against the spring force, it is typically placed immediately on top of the contact arm and toggle mechanism, with a direct transfer of mechanical force. For example, the handle of a circuit breaker pivots and applies a force, through the collapsible toggle linkage on the contact arm.

The trip mechanism, on the other hand, applies a much lower force, which is multiplied by the toggle linkage, to trigger the collapse of the toggle arm and swing of the contact arm. For efficiency, the sensing mechanism has traditionally been mounted on the same frame, opposite to the contact arm. This arrangement is spatially compact, and provides relatively short internal electrical paths for the current flow.

This arrangement places the magnetohydrodynamic coil, the toggle mechanism, and the arc chute in series, and together they determine the total height of the circuit breaker. Typically, the proportions of these three elements are 30% for the magnetohydrodynamic coil, 40–45% for the toggle mechanism, and 25–30% for the arc chute.

One popular circuit breaker design has a total housing height of about 2 inches, with a toggle mechanism occupying about 0.8". In communications equipment applications, equipment is generally housed in equipment racks complying with EIA-310-D, which defines a cabinet height in multiples of about 1.75 inches. A 2 inch breaker will therefore not fit with its height aligned with the cabinet height in a 1U cabinet. Likewise, for larger circuit breaker sizes, similar issues may arise leading to an inefficient utilization of cabinet height.

For a given electrical rating, which is strongly influenced by the size of the contact mechanism and clearances, the height dimension of the breaker has traditionally thus been limited in its minimum size. Thus, the art requires a circuit breaker design having a reduced height dimension with comparable electrical ratings to traditional designs.

SUMMARY AND OBJECTS OF THE INVENTION

The present invention therefore provides a rearrangement and modification of the internal elements of the circuit breaker to provide a circuit breaker height that is significantly less than the prior art for a corresponding circuit breaker electrical performance.

According to an aspect of the present invention, the trip sensing mechanism, e.g., the current sensing coil, is disposed beneath the toggle mechanism and contact arm, such that the contact arm resides between the breaker manual interface and the trip sensing mechanism. The current sensing coil may be mounted on a common or separate frame, and may be aligned to have a magnetic axis at any angle.

The current sensing coil is preferably a magnetohydrodynamic sensing coil, i.e., a magnetic coil having a fluid damped response. This coil provides a number of advantages over known bimetallic element thermal breakers. A principal relevant advantage according to the present invention is the ability of the magnetohydrodynamic sensing coil to provide consistent operating over a wide range of temperatures, for example −40° C. to +80° C. Thermal breakers, on the other hand, are influenced by ambient temperature, and, for example, do not fare well in the 60–65° C. ambient temperatures that may be found in rack-mount equipment. Such magnetohydrodynamic coils have a finite size, and produce a relatively low trip force. Therefore, the toggle arm mechanism must respond to a relatively lower force than that produced by a bimetallic thermal trip sensing element.

A so-called thermal magnetic current sensing coil provides a composite thermal trip element and a magnetic element, which together provide a damped response for low over-currents (thermal) and a relatively undamped response for high overcurrents (magnetic).

According to a preferred embodiment of the invention, the current sensing coil has a magnetic axis aligned with the axis formed by the external handle, toggle mechanism, and current sensing coil. In this arrangement, the armature of the trip sensing mechanism is the most significantly altered internal component of the circuit breaker. In other words, the external handle or manual switch interface, over-center mechanism (including the contact arm and collapsible toggle linkage), and current sensing coil are each relatively unchanged from a corresponding regular form factor circuit breaker.

In the case of an indicating circuit breaker, the sensing switch may be located above the contact arm, or beneath the current sensing element.

According to another aspect of the present invention, the design is compatible with essentially all commonly used improvements and accessories for circuit breakers, for example, multi-pole configurations with joined trip mechanisms, parallel contact arm configurations, mid-trip stop systems, and the like.

According to another aspect of the invention, a common housing form factor is provided for a plurality of breakers having differing internal configurations and specifications. Thus, a modular system is contemplated, wherein breakers having a range of electrical ratings and various other characteristics are provided. In some of these designs, an arrangement with the external handle, over-center mechanism, and current sensing coil aligned along a common axis will be important for fitting the breaker into a EIA-310-D 1U height form factor cabinet, while in others, this may not be necessary. Therefore, it is an aspect of the invention to provide a circuit breaker housing, for example comprising housing halves and a faceplate, adapted for enclosing a circuit breaker, and optionally having a side port for venting an arc chamber therewithin, adapted for self-locking front insertion into a faceplate panel of a 1U height EIA-310-D form factor cabinet. Likewise, larger circuit breakers may be reconfigured according to the present invention to meet the dimensional constraints of 2U, 3U, etc. cabinets. These housings preferably provide a set of common external mechanical constraints, for a variety of breaker configurations.

In traditional hydraulic-magnetic circuit breaker designs, the manual switch control handle is closely linked to the toggle mechanism, which is generally configured as a six link over-center collapsible arm, which in turn selectively supplies a holding force on the contact bar to maintain the circuit in the ON state against a large spring force. When a trip condition occurs, for example due to a sufficient overcurrent in the sensing coil, a small force is applied to the toggle arm, which then collapses, allowing the contact bar to rapidly separate the contacts. The handle applies the necessary forces to overcome the contact spring force, to again close the circuit. These traditional designs therefore provide a direct mechanical connection between an integral handle element and the collapsible toggle linkage of the over-center contact mechanism.

It is also possible, according to an embodiment of the present invention, to rearrange the manual switch control to be placed generally along the axis of the contact bar while the switch is in the closed position. Generally, this will require at least one an additional link between the handle and the contact bar. In addition, this may require a redesigned arc chamber and associated port, since the contact bar will no longer open along an arc adjacent to a wall of the housing.

It is also possible, according to another embodiment of the invention, to place the contact mechanism side-by-side with the current sensing coil, although this would generally increase the circuit breaker width. This configuration may be especially advantageous in the case of a parallel contact circuit breaker, i.e., one in which current is shared among a plurality of contact sets, with a single current sensing coil. In a multipole breaker, it may be possible to situate all of the coils together. Therefore, according to this embodiment, the invention provides a magnetic circuit breaker having a housing, having therewithin a contact mechanism having a contact bar rotational axis, and associated arc chute, the housing having an external manual interface on a front surface, and a pair of side walls not intersecting said axis, wherein no substantial structures of the circuit breaker are disposed between the contact mechanism and associated arc chute and the side walls. In particular, the current sensing coil is disposed elsewhere. The sensing coil, according to the present invention, does not substantially contribute to the minimum required height of the circuit breaker housing.

It is therefore an object according to the present invention to provide a circuit breaker comprising a housing having a height adapted to fit within an EIA-310-D (Aug. 24, 1992) standard height cabinet, for example 1U, 2U, 3U, etc., while having electrical performance which approximates that of a larger height breaker having a conventional configuration. For example, the present invention allows use of a contact mechanism having a 0.7" contact bar within a 1U height breaker, which would not fit according to conventional designs.

It is a further object according to the present invention to provide a circuit breaker comprising a manual control, an over-center contact mechanism, and a sensing coil, wherein said an over-center contact mechanism is disposed between said external manual control and said sensing coil.

It is a another object according to the present invention to provide a circuit breaker comprising a collapsible toggle linkage for selectively applying a force along an axis, and a solenoid, wherein said axis generally intersects said solenoid.

Another object according to the present invention to provide a circuit breaker, comprising collapsible toggle linkage, a contact bar having an open circuit position and a close circuit position, and a current sensing coil, wherein said contact bar is disposed between said collapsible toggle linkage and said current sensing coil.

A still further object according to the present invention to provide a circuit breaker having a current sensing coil, a collapsible toggle linkage, and a contact bar, the improvement comprising providing said current sensing coil opposite said collpsable toggle linkage with respect to said contact bar.

The circuit breaker preferably a housing having less than a minimum height of a 1U cabinet in accordance with EIA-310-D. The circuit breaker preferably comprises a housing which is less than about 1.75 inches in height and less than about 1 inch in width. More preferably, the circuit breaker comprises a housing that is less than about 1.5 inches in height and between about 0.40 and 0.8 inches in width, for example half or three quarter inch nominal width. The circuit breaker may include a pair of internal frames, a first frame for a collapsible toggle linkage and a second frame for a current sensing coil or solenoid, each of said frames being mounted to said housing. The frame may also be common for both the contact mechanism and the current sensing coil.

The circuit breaker may include a sensing electrical switch for indicating a contacting state of the contact mechanism or contact bar, and a linkage between a contact mechanism and said sensing electrical switch for altering a switch state in dependence on said contacting state.

In a telecommunications application, the circuit breaker preferably complies with UL 489A ("Circuit Breaker for Use in Communications Equipment", Jun. 12, 1998) or UL 489, expressly incorporated herein by reference. For example, the circuit breaker may be adapted to break a current of greater than about 3000A, for example 4000A or 5000A or greater, and may be adapted to carry a normal operating current of about 30 amps at 65VDC. UL 489A specifies a 150% current rating with 0.003 second time constant. The operating voltage is preferably 65VDC, and more preferably 80V DC. The breaker is designed, for example, to approach the electrical specifications and options of the Airpax Power Protection Products CEG breaker, which are incorporated herein by reference, while comfortably fitting within a 1U height cabinet.

These and other objects will be apparent from an understanding of the preferred embodiments.

BRIEF DESCRIPTION OF THE DRAWINGS

These and further objects and advantages of the invention will be more apparent upon reference to the following specification, claims and appended drawings wherein:

DESCRIPTION OF THE PREFERRED EMBODIMENTS

Figure 1A:
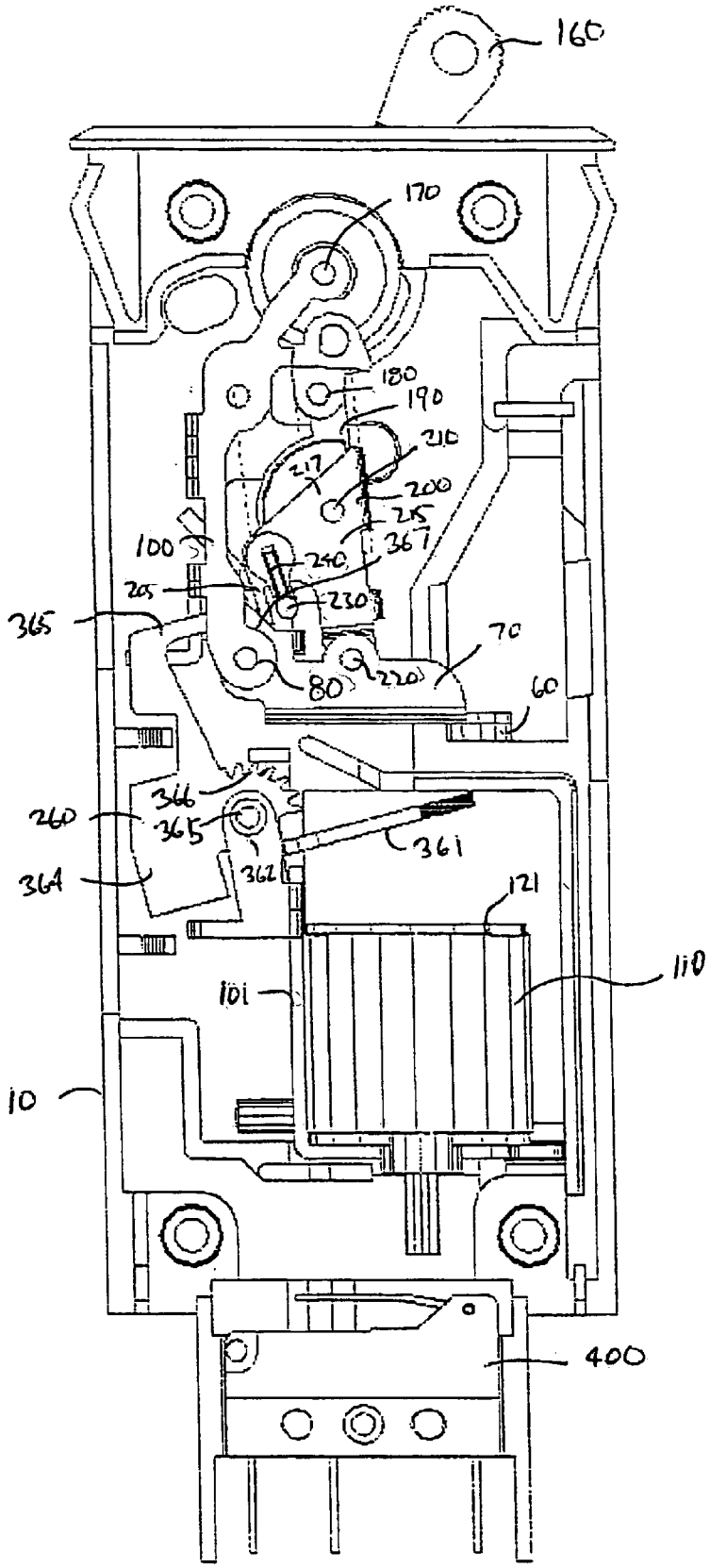
FIGS. 1A and 1B show a side view of a circuit breaker according to the present invention in the open and closed states, respectively, with a housing half removed.

The preferred embodiments will no be described by way of example, in which like reference numerals indicate like elements.

Components of a the circuit breaker are depicted in FIGS. 1A, 1B, 2A and 2B. The contact mechanism and magnetohydrodynamic current sensing coil are similar to that of U.S. Pat. No. 5,293,016, expressly incorporated herein by reference, while their arrangement differs. As shown, the single pole circuit breaker 10 includes an electrically insulating casing 20 which houses, among other things, stationary mounted terminals 30 and 40. In use, these terminals are electrically connected to the ends of the electrical circuit that is to be protected against overcurrents.

As its major internal components, a circuit breaker includes a fixed electrical contact, a movable electrical contact, an electrical arc chute, and an operating mechanism. The arc chute is used to divide a single electrical arc formed between separating electrical contacts upon a fault condition into a series of electrical arcs, increasing the total arc voltage and resulting in a limiting of the magnitude of the fault current. See, e.g., U.S. Pat. No. 5,463,199, expressly incorporated herein by reference.

The trip mechanism includes a contact bar, carrying a movable contact of the circuit breaker, which is spring loaded by a multi-coil torsion spring to provide a force repelling the fixed contact. In the closed position, a hinged linkage between the manual control toggle is held in an extended position and provides a force significantly greater than the countering spring force, to apply a contact pressure between the moveable contact and the fixed contact. The hinged linkage includes a trigger element which, when displaced against a small spring and frictional force, causes the hinged linkage to rapidly collapse, allowing the torsion spring to open the contacts by quickly displacing the moveable contact away from the fixed contact. The trigger element is linked to the trip element.

The casing 20 also houses a stationary electrical contact 50 mounted on the terminal 40 and an electrical contact 60 mounted on a contact bar 70. Significantly, the contact bar 70 is pivotally connected via a pivot pin 80 to a stationary mounted frame 100. A helical spring 85, which encircles the pivot pin 80, pivotally biases the contact bar 70 toward the frame 100 in the counterclockwise direction per FIGS. 1A and 1B. A contact bar stop pin 90 or contact bar stop mounted on the contact bar 70 (or optionally other stop, such as a surface which contacts the frame), limits the pivotal motion of the contact bar 70 relative to the frame 100 in the non-contacting position (contact bar 70 rotated about pin 80 in the counterclockwise direction to separate contacts 50 and 60, not shown in FIG. 1). By virtue of the pivotal motion of the contact bar 70, the contact 60 is readily moved into and out of electrical contact with the stationary contact 50. In the contacting position (shown in FIG. 1), the stationary contact 50 limits the motion of the contact 60, thus limiting the angular rotation of the contact bar 70 about pin 80. The pivot pin 80 sits in a conforming aperture in the frame, while a slot is provided in the contact bar 70 (not shown in FIG. 1) to allow a small amount of vertical displacement. Thus, in the contacting position, the contact bar 70 may be displaced vertically by the pressure of the toggle linkage composed of cam link 190 and link housing 200 in the aligned relative orientation (shown in FIG. 1), against a force exerted by the helical spring 85.

An electrical coil 110, which encircles a magnetic core 120 topped by a pole piece 130, is positioned below the frame 100, on a separate frame 101. An extension 140 of the coil material, typically a solid copper wire, or an electrical braid, serves to electrically connect the terminal 30 to one end of the coil 110. An electrical braid 150 connects the opposite end of the coil 110 to the contact bar 70. Thus, when the contact bar 70 is pivoted in the clockwise direction (as viewed in FIG. 1), against the biasing force exerted by the spring 85, to bring the contact 60 into electrical contact with the contact 50, a continuous electrical path extends between the terminals 30 and 40.

Figure 3A:
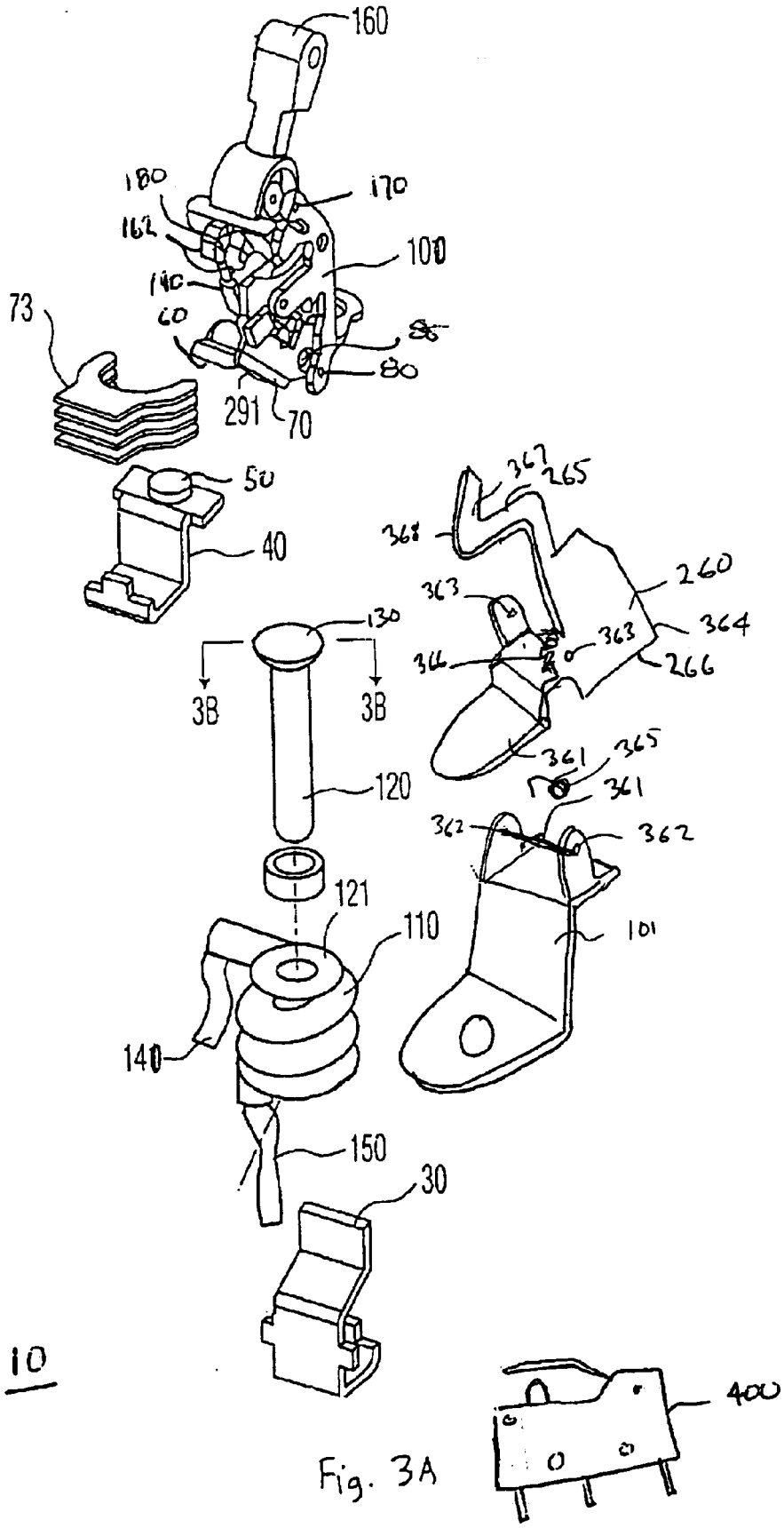
FIGS. 3A and 3B are an exploded view of a circuit breaker mechanism according to the present invention and a detail cross section of a magnetohydrodynamic element, respectively.
Figure 3B:
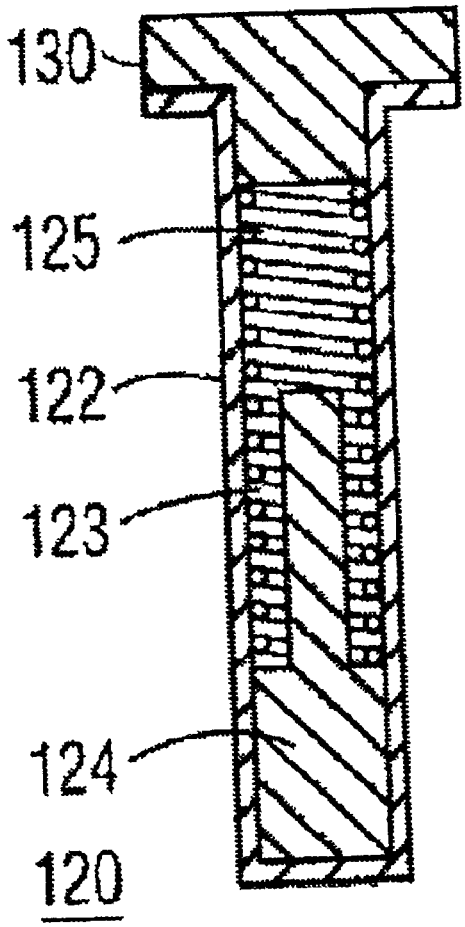

Magnetic core 120 includes a delay tube, shown in greater detail in FIG. 3B. By way of example only, the coil and delay tube assembly may be of the type shown and described in U.S. Pat. No. 4,062,052, expressly incorporated herein by reference.

Magnetic core 120 has at an upper position thereof, a pole piece 130. Adjacent pole piece 130 is an armature 260 pivotally mounted on a pin 320 secured to frame 100. Armature 260 is rotatably biased in a clockwise direction by a spring (not shown), and comprises an arm 265 and a counterweight 266. Counterweight 266 comprises an enlarged extension of armature 260. See, U.S. Pat. Nos. 3,497,838, 3,959,755, 4,062,052, and 4,117,285, expressly incorporated herein by reference.

The delay tube of the magnetic core 120 is a typical design, which is disclosed, for example, in U.S. Pat. No. 4,062,052, expressly incorporated herein by reference. In this design, an outer tube 122 of the magnetic core 120 is supported in the frame 100 by a bobbin 121, about which the coil 110 is formed. The outer tube 122 is a drawn single piece shell, sealed at its open end by the pole piece 130. The interior of the delay tube is conventionally filled with a viscous fluid such as oil. Typically, the viscosity of the oil is selected to provide a desired damping within a standard delay tube design, although mechanical modifications, most notably with respect to the clearance of the outer tube 122 around a magnetic delay core 124 or slug, will also influence the damping or delay of the system. The construction materials of the magnetic delay core 124 or slug and pole piece 130 may also alter the force induced by the coil 110 on the armature 260. The delay core 124 or slug is biased away from the pole piece 130 by a helical spring 123 provided within the outer shell 122. For example, the delay core 124 has an enlarged lower end and a reduced diameter upper end around which a portion of spring 123 passes, and defining an annular shoulder against which the lower end of the spring bears. In conventional circuit breaker delay tubes, the distance from the bottom of the core to the plane containing the bottom of the coil 110, is customarily chosen to be about one-third of the overall interior distance of the delay tube, namely from the bottom of the core to the underside of the pole piece 130. Customarily, the coil 110 surrounds the upper two-thirds of the delay tube outer shell 122. This conventional construction optimizes the delay function of the tube while, at the same time, maintaining the overall length of the tube within reasonable bounds.

When a prolonged overcurrent passes through coil 110, delay core moves upwardly in the outer shell 122, with motion damped by the viscous oil, to compress spring 123 until the upper end of delay core 124 engages pole piece 130, causing an increased magnetic flux in the gap between the pole piece 130 and armature 260, so that the armature 260 is attracted to the pole piece 130 and rotates about its pivot 320 to engage the sear striker bar 240, to result in collapse of the toggle mechanism, separating the electrical contacts and opening the circuit in response to the overcurrent, as will become apparent below.

The circuit breaker 10 also includes a handle 160, which is pivotally connected to the frame 100 via a pin 170. Handle 160 includes a pair of ears 162 with apertures for receiving a pin 180, which connects handle 160 to a cam link 190. In addition, a toggle mechanism is provided, which connects the handle 160 to the contact bar 70. The handle 160 is provided with a helical spring (not shown), which applies a counterclockwise force on the handle 160 about pin 170 with respect to frame 100. A significant feature of the cam link 190, shown in expanded view in FIG. 2B, is the presence of a step, formed by the intersection of non-parallel surfaces 194 and 198, in the outer profile of the cam link 190. Cam link 190 is pivotally connected by a rivet or pin 210 to a link housing 200.

Figure 2A:
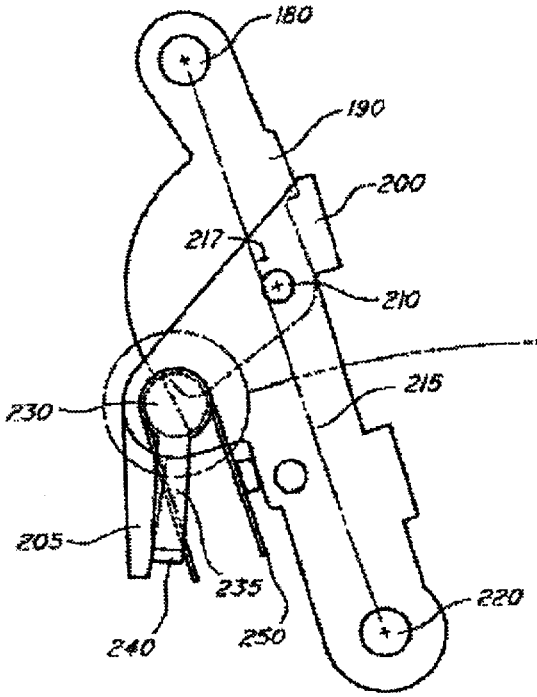
FIGS. 2A and 2B are detail views of a circuit breaker toggle mechanism.
Figure 2B:
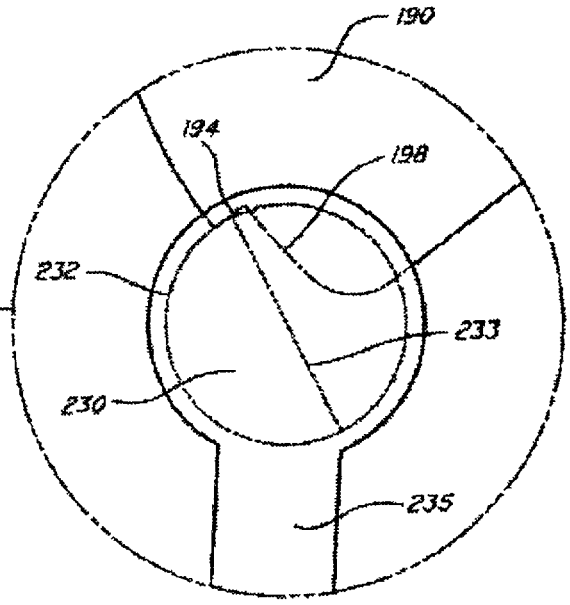

With further reference to FIGS. 2A and 2B, the toggle mechanism of the circuit breaker 10 also includes a link housing 200, which is further connected a projecting arm 205. The link housing 200 is pivotally connected to the cam link 190 by a pin or rivet 210 and pivotally connected to the contact bar 70 by a rivet 220.

The toggle mechanism further includes a sear assembly, including a sear pin 230, which extends through an aperture in the link housing 200 generally corresponding to a location of an outer edge 195 of the cam link 190. This sear pin 230 includes a circularly curved surface 232 (see FIG. 2B) which is intersected by a substantially planar surface 233. The sear assembly also includes a leg 235 (see FIG. 2A), connected to the sear pin 230, and a sear striker bar 240, which is connected to the leg 235 and projects into the plane of the paper, as viewed in FIG. 2A. A helical spring 250, which encircles the sear pin 230, pivotally biases the leg 235 of the sear assembly clockwise, into contact with the leg 205 of the link housing 200, and biasing the planar surface 233 of the sear pin 230 into substantial contact with the bottom surface 198 of the step in the cam link 190. A force exerted against the sear striker bar 240 is transmitted to the leg 235, and acts as a torque on the sear pin 230 to angularly displace the substantially planar surface 233 of the sear pin 230 from coplanarity the surface 198 of the cam link 190, thus raising the leading edge 234 of the substantially planar surface 233 of the sear pin 230 above the top edge of the surface 194. This rotation results in elimination of a holding force for the contact bar 70 in the contacting position, generated by the helical spring 85 acting on the contact arm 70, through the rivet 220 and link housing 200 and sear pin 230 leading edge 234, against the surface 194 of the cam link 190, acting on the pin 180, ears 162 of handle 160, held in place by pin 170 with respect to the casing 20 and frame 100.

The initial clockwise rotation of the cam link 190 is limited by a hook 199 in the outer profile of the cam link 190, at a distance from the step, which partially encircles, and is capable of frictionally engaging, the sear pin 230. In addition, the distance from the step to the hook 199 is slightly larger than the cross-sectional dimension, e.g., the diameter, of the sear pin 230. This dimensional difference determines the amount of clockwise rotation the cam link 190 undergoes before this rotation is stopped by frictional engagement between the hook 199 and the sear pin 230.

As a consequence, the sear pin 230 engages the step in the cam link 190, i.e., a portion of the surface 194 of the cam link 190 overlaps and contacts a leading portion of the curved surface 232 of the sear pin 230. Thus, it is by virtue of this engagement that the toggle mechanism is locked and thus capable of opposing and counteracting the pivotal biasing force exerted by the spring 85 on the contact bar 70, thereby maintaining the electrical connection between the contacts 50 and 60.

By manually pivoting the handle 160 in the counterclockwise direction (as viewed in FIGS. 1A and 1B), the toggle mechanism, while remaining locked, is translated and rotated out of alignment with the pivotal biasing force exerted by the spring 85 on the contact bar 70. This biasing force then pivots the contact bar 70 in the counterclockwise direction, toward the frame 100, resulting in the electrical connection between the contacts 50 and 60 being broken, thus assuming a non-contacting position. When in the full counterclockwise position, the handle 160 applies a slight tension or no force on the cam link 190, resulting in a full extension of the cam link 190 with respect to the link housing 200. In this position, the leading edge of the surface 232 of the sear pin 230 engages the surface 194, and thus the toggle mechanism is in its locked position. Therefore, manually pivoting the handle 160 from the left to right, i.e., in the clockwise direction, then serves to reverse the process to close the contacts 50, 60, since a force against the action of spring 85 is transmitted by clockwise rotation of the handle to the contact bar 70.

Figure 1B:
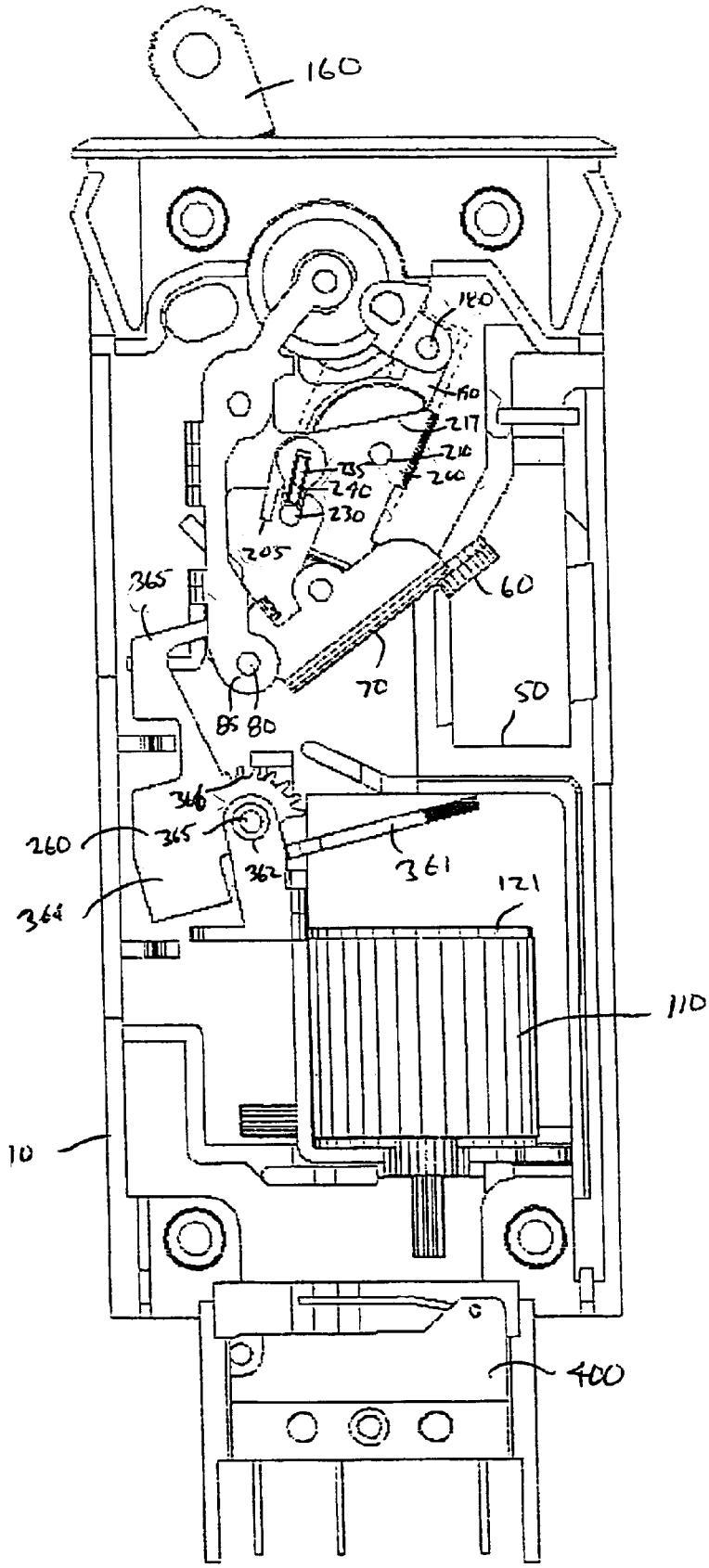

As shown in FIGS. 1A and 1B, the armature 260, pivotally connected to the frame 100, includes a leg 265 which is positioned adjacent the sear striker bar 240. In the event of an overcurrent in the circuit to be protected, this overcurrent will necessarily also flow through the coil 110, producing a magnetic force that induces the armature 260 to pivot toward the pole piece 130. As a consequence, the armature leg 265 will strike the sear striker bar 240, pivoting the sear pin 230 out of engagement with the step (intersection of surfaces 194, 198) in the cam link 190, thereby allowing the force of spring 85 to collapse the toggle mechanism. In the absence of the opposing force exerted by the toggle mechanism, the biasing force exerted by the spring 85 on the contact bar 70 will pivot the contact bar 70 in the counterclockwise direction, toward the frame 100, resulting in the electrical connection between the contacts 50 and 60 being broken.

As a safety precaution, the operating mechanism is configured to retain a manually engageable operating handle 160 in its ON or an intermediate, tripped position (by a mechanism not shown in the figures), if the electrical contacts 50, 60 are welded together. Thus, the handle 160 will not assume the OFF position if the contacts are held together. In addition, if the manually engageable operating handle 160 is physically restricted or obstructed in its ON position, the operating mechanism is configured to enable the electrical contacts 50, 60 to separate upon a trip, e.g., due to an overload condition or upon a short circuit or fault current condition. See, U.S. Pat. No. 4,528,531, expressly incorporated herein by reference.

Two or more single pole circuit breakers 10 are readily interconnected to form a multipole circuit breaker. In this configuration, each such single pole circuit breaker 10 further includes a trip lever that is pivotally connected to the frame 100. Contacts may also be situated in parallel to provide increased current carrying capability, for example with a modified coil to control the trip current. The trip lever includes an extension that passes through a wall of the housing, to link the contact arm of one breaker mechanism with the trip mechanism of an adjacent breaker mechanism. The handles of the breakers are mechanically linked to move in unison. See, e.g., U.S. Pat. Nos. 5,557,082, 5,214,402, 5,162,765, 5,117,208, 5,066,935, and 4,912,441, expressly incorporated herein by reference. See also, 4,492,941, 4,437, 488, 4,276,526, and 3,786,380, expressly incorporated herein by reference.

The circuit breaker includes a housing formed of half casings of electrically insulating material, such as plastic. During assembly, the casing halves are secured together by rivets or similar fasteners (not shown) through a plurality of upper and lower fastener holes. The housing also includes a front faceplate.

To extinguish arcing caused by opening of the contacts 50 and 60, a stacked array of metal plates are supported within and by the two housing halves of the circuit breaker, around the moveable contact arm 70. During operation, the quenched arc from the contacts is allowed to escape from the breaker housing through an aperture, not shown. This aperture should be left open, to avoid shorting.

The armature 260 is mounted on a separate frame 101 with the coil 110 and magnetohydrodynamic element 120. The armature 260 has a magnetically permeable input portion 361, which is attracted to the pole piece 130 of the magnetohydrodynamic element 120, depending on the current passing through the coil 110 and the dynamic position of the magnetic delay core 124 within the tube 122. The armature 260 pivots about pivot pin 361, which passes through holes 362 in the frame 101 and holes 363 in the armature 260. Spring 365 sits around pin 362, and urges the armature 260 away from the frame 101. The spring tension is adjustable by selectively placing the end of the spring in a detent 366. Leg 367 includes surface 368 that is adapted to contact and displace sear striker bar 240 when the armature 260 is pulled toward the pole piece 130. It is noted that the coil 110 may also be rotated 90 degrees (or other angle) from the orientation provided in FIGS. 1A and 1B, without significant changes to the operation thereof. Further, the frame 100 and frame 101 may be integral, without altering the nature of the invention. Thus, design considerations, such as cost, may determine the orientation of the coil and whether there are two frames or a single frame.

A sensing switch 400 may be provided beneath the frame 101, controlled by a linkage (not shown) from the contact arm 70.

The mechanical elements of the circuit breaker fit within a pair of housing halves, to form a complete housing 20. In a preferred embodiment having a height which allows installation with a horizontal axis of movement for the external toggle 160 in an EIA-310-D (September 1992, expressly incorporated herein by reference) 1U height cabinet, the housing 20 is preferably less than about 1.75 inches in height, and more preferably less than about 1.5 inches in height. The housing 20 preferably has a pair of resilient arms 22 extending outward near the front surface, which allow the housing 20 to be inserted through a front panel and retained in place. Alternately, the housing 20 may be mounted using screws into threaded inserts (not shown) to an equipment faceplate The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

The term "comprising", as used herein, shall be interpreted as including, but not limited to inclusion of other elements not inconsistent with the structures and/or functions of the other elements recited.

What is claimed is:

1. A circuit breaker comprising a manually operable lever, a mechanical trip mechanism comprising an over-center toggle mechanism a current sensing coil, and a contact arm, said contact arm being settable by said manually operable lever and resetable by said mechanical trip mechanism based on a current passing through said current sensing coil, said circuit breaker further comprising an elongated housing, wherein said manually operable lever, said mechanical trip mechanism, and said current sensing coil are disposed at substantially different depths along said elongated housing with respect to said contact arm, wherein said housing has a maximum height of a surface from which said manually operable lever protrudes, of less than about 1.75 inches, and said contact arm is adapted to break a current of at least 1000A and 65 VDC nominal.

2. The circuit breaker according to claim 1, wherein said contact arm is disposed between said sensing coil and mechanical trip mechanism.

3. The circuit breaker according to claim 1, wherein said current sensing coil is magnetohydrodynamically damped.

4. The circuit breaker according to claim 1, wherein said circuit breaker complies with the electrical performance specification of UL 489A.

5. The Circuit breaker according to claim 1, wherein said housing is adaptod to be inserted along its elongated axis into a faceplate of a piece of equipment, said manually operable lever extending from said faceplate.

6. A circuit breaker comprising a manually operable lever, a mechanical trip mechanism comprising an over-center toggle mechanism, a current sensing coil, and a contact arm, said contact arm being settable by said manually operable lever and resetable by said mechanical trip mechanism based on a current passing through said current sensing coil, said circuit breaker further comprising an elongated housing, wherein said mechanical trip mechanism is disposed between said manually operable lever and said current sensing coil, wherein said housing as a maximum height of a surface from which said manually operable lever protrudes, of less than about 1.75 inches, and said contact arm is adapted to break a current of at least 1000A and 65 VDC nominal.

7. The circuit breaker according to claim 6, wherein said circuit breaker comprises a housing adapted to be installed through a front race plate, wherein said housing comprises at least one resilient leg for retaining said housing within said front face plate.

8. The circuit breaker according to claim 6, wherein said circuit breaker comprises a housing, in which said mechanical trip mechanism, said current sensing coil, and said contact arm are contained, having external dimensions which are less than about 1.75 inches in height and less than about 1 inch in width.

9. The circuit breaker according to claim 6, wherein said circuit breaker comprises a housing, in which said mechanical trip mechanism, said current sensing coil, and said contact arm are contained, having external dimensions which are less than about 1.5 inches in height and less than about 0.75 inch 11 width.

10. The circuit breaker according to claim 6, wherein said circuit breaker comprises a sensing electrical switch for sensing a contacting state of said contact arm, and a linkage between said contact arm and said sensing electrical switch having an alterable switch state in dependence on said contacting state.

11. The circuit breaker according to claim 6, wherein said circuit breaker comprises a housing having a height, in which said mechanical trip mechanism, said current sensing coil, and said contact arm are contained, said height being measured along an taxis parallel to the axis of said contact arm in a contacting state, wherein said contact arm has a length of about 50% of the housing height.

12. The circuit breaker according to claim 6, wherein said circuit breaker complies with UL 489A.

13. The circuit breaker according to claim 6, wherein said circuit breaker is adapted to break a current of greater than about 3000A.

14. The circuit breaker according to claim 6, wherein said circuit breaker is adapted to carry an operating current of about 30 amps at 65VDC.

15. The circuit breaker according to claim 6, wherein said circuit breaker comprises a housing, in which said mechanical hip mechanism, said current sensing coil, and said contact arm are contained, said circuit breaker further comprising a pair of internal frames, a first frame for a collapsible toggle linkage and a second frame for a current sensing coil, each of said frames being mounted to said housing.

16. A circuit breaker comprising a manually operable lever, a mechanical trip mechanism comprising a collapsible toggle linkage for selectively applying a force along an axis, a current sensing coil, and a contact arm, said contact arm being settable by said manually operable lever and resetable by said collapsible toggle linkage based on a current passing through said current sensing coil, wherein said axis generally intersects said current sensing coil, wherein said housing has a maximum height of a surface from which said manually operable lever protrudes, of less than about 1.75 inches, and said contact arm is adapted to break a current of at least 1000A and 65 VDC nominal.

17. The circuit breaker according to claim 16, wherein said circuit breaker comprises a housing, said housing having a height, adapted to permit installation within a 1U cabinet in accordance with EIA-310-D, with the manually operable lever outside the cabinet, and with the height of said circuit breaker aligned with the height of said cabinet.

18. The circuit breaker according to claim 16, wherein said circuit breaker comprises a housing adapted to be installed through a front face plate of a cabinet, wherein said housing comprises at least one resilient leg for retaining said housing within said front faire plate.

19. The circuit breaker according to claim 16, wherein said circuit breaker comprises a sensing electrical switch for sensing a contacting state of said contact arm, and a linkage between said contact arm and said sensing electrical switch for altering a switch state in dependence on said contacting state.

20. The circuit breaker according to claim 16, wherein said circuit breaker complies with UL 489A.

21. The circuit breaker according to claim 16, wherein said circuit breaker comprises a pair of separate internal frames, a first frame for said collapsible toggle linkage and a second frame for said current sensing coil, each of said frames being mounted to a common housing.

22. The circuit breaker according to claim 16, wherein said collapsible toggle linkage comprises an over-center contact mechanism disposed between said manually operable lever and said current sensing coil.

23. A circuit breaker comprising a manually operable lever, a mechanical trip mechanism comprising an over-center trip mechanism, a current sensing coil, and a contact arm, said contact arm being settable by said manually operable lever and reactable by said mechanical trip mechanism based on a current passing through said current sensing coil, wherein said over-center contact mechanism is disposed between said manually operable lever and said current sensing coil, wherein said housing has a maximum height of a surface from which said manually operable lever protrudes, of less than about 1.75 inches, and said contact an is adapted to break a current of at least 1000A and 65 VOC nominal.

24. The circuit breaker according to claim 23, further comprising a housing having a front face, said manually operable lever having a portion extending through said front face.

25. The circuit breaker, according to claim 23, wherein said over-center trip mechanism comprises a collapsible toggle linkage, said contact arm having an open circuit position and a closed circuit position, said contact arm being disposed between said collapsible toggle linkage and said current sensing coil.

26. The circuit breaker according to claim 23, wherein said over-center trip mechanism comprises a collapsible toggle linkage for selectively applying a force along an axis, wherein said axis generally intersects said current sensing coil.

27. The circuit breaker according to claim 23, wherein said circuit breaker comprises a housing having a height adapted to tit within a 1U cabinet in accordance with EIA-310-D, wherein a said manually operable lever has an axis of movement along the height axis.

28. The circuit breaker according to claim 23, wherein said circuit breaker comprises a housing adapted to be installed through a front face plate of a cabinet, wherein said housing comprises at least one resilient leg for retaining said housing within said front face plate.

29. The circuit breaker according to claim 23, wherein said circuit breaker comprises a housing encompassing said over-center trip mechanism, said current sensing coil, and said contact arm, and a pair of internal frames, a first frame for supporting said over-center trip mechanism and a second frame for supporting said current sensing coil, each of said frames being mounted to said housing.

30. The circuit breaker according to claim 23, wherein said circuit breaker comprises:

a housing having a height having a height axis measured along an axis parallel to the axis or said contact arm in a contacting state;

said housing being adapted to be installed through a front face plate, wherein said housing comprises at least one resilient leg for retaining said housing within said front face plate;

said mechanical trip mechanism, said current sensing coil, and said contact arm being contained within said housing;

a pair of internal frames, a first frame for a collapsible toggle linkage and a second frame for a current sensing coil, each of said frames being mounted said housing;

said housing having external dimensions which are less than about 1 inches in height and less than about 1 inch in width;

a sensing electrical switch for sensing a contacting state of said contact arm, and a linkage between said contact arm and said sensing electrical switch having alterable switch state in dependence on said contacting slate; and said contact arm having a length of about 50% of the housing height;

wherein said circuit breaker complies with UL 489A and is adapted to break a current of greater than about 3000A and carry an operating current or about 30 amps at G5VDC.

* * * * *